US007237303B2

(12) United States Patent
Schorling

(10) Patent No.: US 7,237,303 B2
(45) Date of Patent: Jul. 3, 2007

(54) CURTAIN SUSPENSION DEVICE AND A METHOD OF SUSPENDING CURTAINS

(75) Inventor: Stefan Schorling, Fellingsbro (SE)

(73) Assignee: WIDA Media AB, Koping (SE)

( * ) Notice: Subject to any disclaimer, the term of this patent is extended or adjusted under 35 U.S.C. 154(b) by 85 days.

(21) Appl. No.: 10/500,612

(22) PCT Filed: May 20, 2003

(86) PCT No.: PCT/SE03/00813

§ 371 (c)(1),
(2), (4) Date: Jun. 29, 2004

(87) PCT Pub. No.: WO03/096852

PCT Pub. Date: Nov. 27, 2003

(65) Prior Publication Data

US 2005/0087659 A1 Apr. 28, 2005

(30) Foreign Application Priority Data

May 22, 2002 (SE) ..... 0201548
Sep. 12, 2002 (SE) ..... 0202700

(51) Int. Cl.
*E05D 15/00* (2006.01)

(52) U.S. Cl. ..... 16/87.2; 160/330; 248/215

(58) Field of Classification Search ..... 16/87.2, 16/87 R, 94 R, 95 R, 96 R, 87 B; 24/716, 24/369–370; 248/215 X, 340; 294/26, 27.1; 223/85; 211/113, 106, 106.1, 105.1, 123; 160/330, 126, 330 X, 196.1; D8/367–368, D8/370

See application file for complete search history.

(56) References Cited

U.S. PATENT DOCUMENTS

| | | | | |
|---|---|---|---|---|
| 180,108 | A * | 7/1876 | Calhoun | 16/87.2 |
| 433,838 | A * | 8/1890 | Weidenfeld | 16/87.2 |
| 515,097 | A * | 2/1894 | Schofield | 16/93 D |
| 1,939,499 | A | 12/1933 | Holt | |
| 1,966,283 | A * | 7/1934 | Brody | 211/123 |
| 2,115,593 | A * | 4/1938 | Strube | 160/348 |
| 2,239,631 | A * | 4/1941 | Tendrich et al. | 160/126 |
| 2,320,308 | A * | 5/1943 | Silverman | 16/87.2 |
| 2,388,061 | A * | 10/1945 | Isserstedt | 160/84.01 |
| 2,480,327 | A * | 8/1949 | Idelsohn | 211/113 |
| 2,599,429 | A * | 6/1952 | Bernhard | 160/348 |
| 2,699,263 | A * | 1/1955 | Ore | 211/113 |
| 2,911,176 | A * | 11/1959 | Roediger | 248/220.1 |

(Continued)

FOREIGN PATENT DOCUMENTS

| | | |
|---|---|---|
| CH | 648487 | 3/1985 |

(Continued)

*Primary Examiner*—Chuck Y. Mah
(74) *Attorney, Agent, or Firm*—Mark P. Stone

(57) ABSTRACT

A curtain suspension device for hanging curtains flatly (for hanging panel curtains) comprises a main rod (16) arranged to a wall and at least two elongate shorter rods (15) with open books (17, 26) at both ends. The short rods are adapted to be hung on the main rod and are adapted to carry a flat hanging curtain each. The brackets for the main rod clamp the rod and leave the upper surface of the rod free as a sliding surface for the hooks so that the hooks can pass the brackets.

17 Claims, 3 Drawing Sheets

U.S. PATENT DOCUMENTS

| | | | | | |
|---|---|---|---|---|---|
| 2,927,762 | A | * | 3/1960 | Owsiak | 248/262 |
| 3,347,306 | A | * | 10/1967 | Potye | 160/344 |
| 3,482,618 | A | * | 12/1969 | Johnson et al. | 160/345 |
| 4,719,957 | A | * | 1/1988 | Strelnieks | 160/332 |
| D300,804 | S | * | 4/1989 | Myers | D8/373 |
| 4,872,568 | A | * | 10/1989 | Lehmann | 211/113 |
| D317,858 | S | * | 7/1991 | Hoskinson et al. | D8/370 |
| D396,371 | S | * | 7/1998 | Oliver | D6/552 |

FOREIGN PATENT DOCUMENTS

| | | | | |
|---|---|---|---|---|
| CH | 657511 | A5 | * | 9/1986 |
| CH | 648487 | A5 | * | 3/1995 |
| DE | 511053 | | | 10/1930 |
| DE | 3713174 | A1 | * | 10/1987 |
| DE | 29915818 | U1 | * | 12/1999 |
| DE | 19920105 | | | 5/2000 |
| ES | 262343 | | | 8/1932 |
| FR | 2736382 | A1 | * | 1/1997 |
| GB | 2243539 | A | * | 11/1991 |
| GB | 2389786 | A | * | 12/2003 |
| JP | 11276797 | A | * | 10/1999 |
| JP | 2000210497 | A | * | 8/2000 |
| JP | 2003062395 | A | * | 3/2003 |
| JP | 2003144306 | A | * | 5/2003 |

* cited by examiner

CURTAIN SUSPENSION DEVICE AND A METHOD OF SUSPENDING CURTAINS

TECHNICAL AREA OF THE INVENTION

This invention relates to a curtain suspension device for hanging curtains flatly and to a method of hanging curtains flatly so that they become slideable on a curtain rod.

BRIEF DESCRIPTION OF THE PRIOR ART

Usually, for flat hanging of curtains, aluminium profiles are used which have a number of parallel grooves horizontally next to one another, one groove for each curtain.

OBJECT OF INVENTION

It is an object of the invention to provide, with simple means and at a low cost, a curtain arrangement with flatly hanging displaceable curtains (panel curtains) suitable not only for public surroundings, but also for homes. This is fulfilled in the way defined in the claims.

DESCRIPTION OF THE ILLUSTRATED EMBODIMENT

Figure 1:
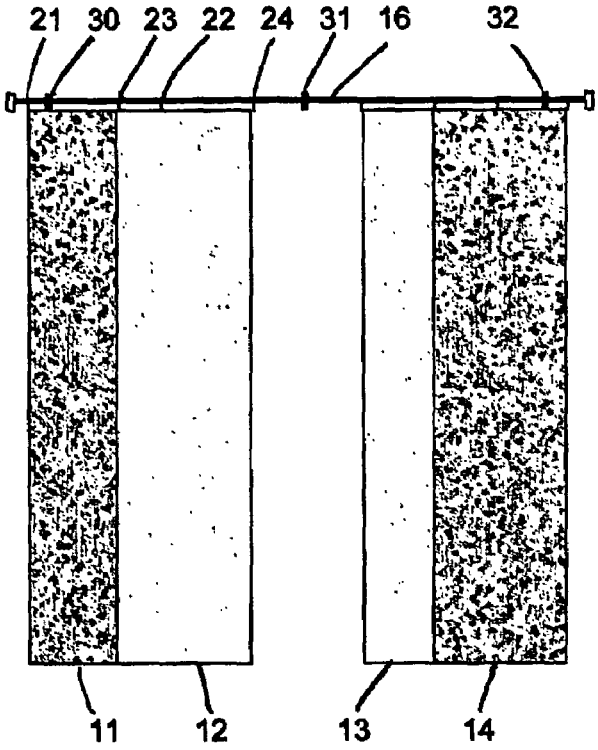
FIG. 1 shows a curtain arrangement in accordance with the invention with flatly hanging curtains.
Figure 2:
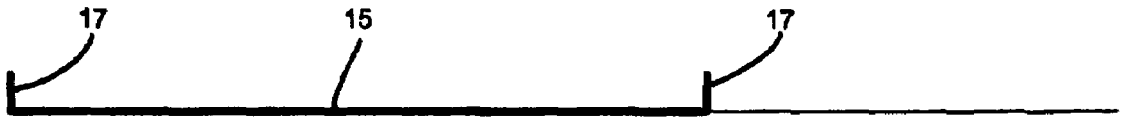
FIG. 2 shows a hanger for a curtain as a part of the curtain arrangement according to FIG. 1.
Figure 3:
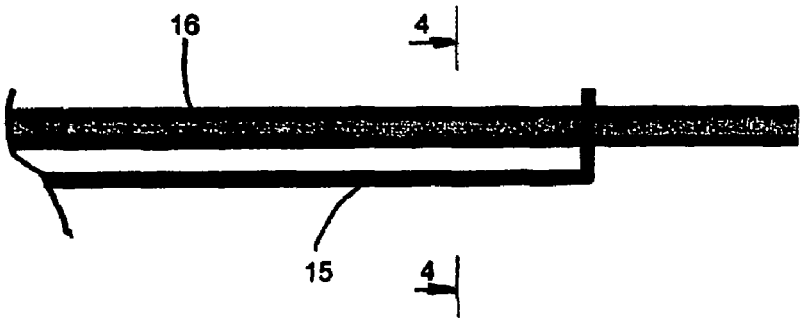
FIG. 3 shows the hanger according to FIG. 2 mounted on the conventional curtain rod that is also shown in FIG. 1.
Figure 4:
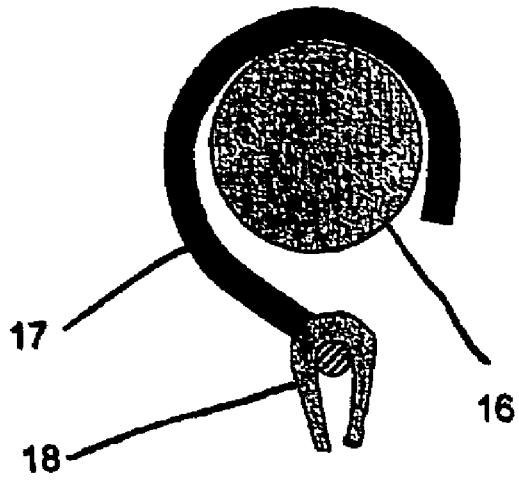
FIG. 4 is a section along line 4-4 in FIG. 3.

In FIG. 1, a curtain arrangement is shown that has four flatly hanging curtains 11, 12, 13, 14; two on each side of the window. Each curtain (panel curtain) hangs on a panel hanger 15 of the kind shown in the FIGS. 2-4. These four panel hangers are suspended on a conventional curtain rod 16 that has three wall brackets 30, 31, 32. The panel hangers 15 are comprised of a rod made of hard, cold reduced 5 mm steel wire and their ends are bent into hooks 17 as shown in FIG. 4, and the panel hangers are suspended on the curtain rod 16. The hooks have openings that are at least as big as the diameter of the curtain rod so that they can be laid onto the curtain rod. The curtains are sewn with a narrow channel at their upper ends and the panel hanger is threaded into the channel. The channel can be so narrow that that it must be threaded along the hook or it can be so wide that the entire hook can be moved into It Alternatively, the curtain may have a VELCRO© fastening and be bent over the panel hanger and attached to its own VELCRO© fastening. Suitably, a skid fillet 18 of plastics can be fixed to the curtain mounting on each panel hanger. The hooks may have openings that are smaller than the diameter of the curtain rod if they for example have a spring device so that they can be forced onto the rod. They will then be locked on the rod in such a way that they cannot unintentionally be hooked off.

It is also possible to have hooks that are threaded onto the curtain rod from the end but the illustrated simple design is preferred.

Instead of manufacturing the hangers in one piece as shown, it is possible to have a straight rod, that can be a steel rod, and separate hooks, for example of plastics, that are forced onto the rod. Such a design gives flexibility as to the length of the hanger since the rod can then be easily cut to desired length.

FIG. 1 shows the panel hangers of the two left curtains hung overlapping on the rod 16, that is, one of the panel hangers has its hooks 21,22 and the other panel hanger has its hooks 23,24. The curtains can then be moved so that one hangs behind the other or so that they hang side by side. The sliding fillets 18 prevent the curtains from sliding directly against each other. The curtains to the right are suspended in the same way as he ones to the left.

Figure 5:
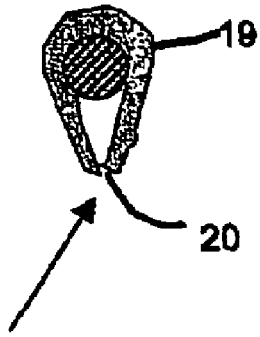
FIG. 5 shows an alternative design of a detail shown in FIG. 4.

FIG. 5 shows an alternative design of the sliding fillet 18 in FIG. 4. The sliding fillet 19 in FIG. 5 is springy so that its legs are forced together and one of the legs has a point 20 so that the curtain can be clamped in the sliding fillet instead of being threaded onto the panel hanger.

Figure 6:
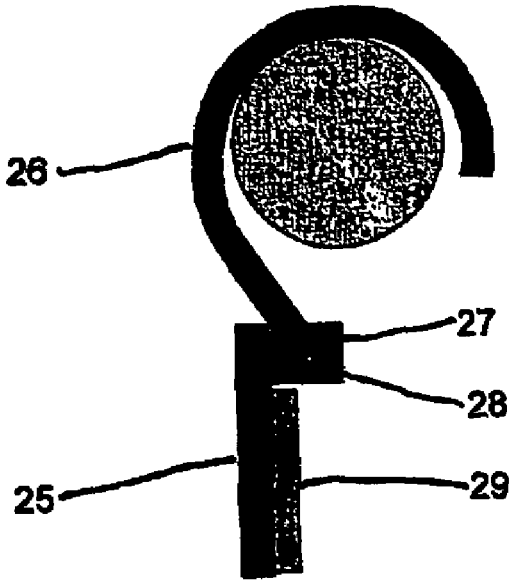
FIG. 6 shows in a section a modified design of a part of the hanger shown in FIGS. 2-4.

FIG. 6 shows an alternative design of the panel hanger. It comprises an aluminium profile 25 which has hooks 26 at both ends. The hooks of steel can be screwed into threaded holes in the profile as indicated at 27. The profile has a skid heel 28 and a VELCRO© fastening tape at its flat surface so that the curtains can slide against each other when two panel hangers are overlapping in the same way as described with reference to FIG. 1. The skid heel on one of the panel hangers will then slide against the flat back of the other panel hanger. The hooks can be affixed in another way then shown. The hooks can for example be of plastics and glued to the profile. Unlike the hooks shown in FIG. 4, the hooks have such a small opening that they cannot be laid onto the rod but the hangers are mounted by being thread onto the rod axially. However, the openings of the hooks permit the hooks to pass the wall brackets.

Figure 7:
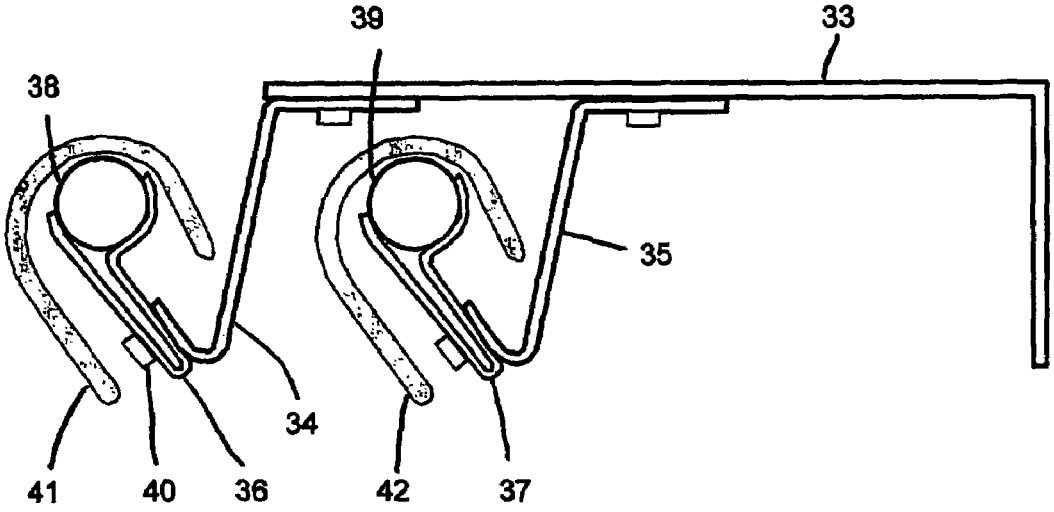
FIG. 7 shows in a side view a curtain rod bracket.

FIG. 7 shows one of the wall brackets 30-32 and it consists of an angle 33 made of sheet steel onto which two upward directed attachments 34,35 of sheet steel are screw fixed. Spring clamps 36,37 are screwed to the attachments 34,35 so that they clamp the curtain rods 38,39. When only one curtain rod is used as shown in FIG. 1, only one of the attachments 34,35 is fixed. The same screw 40 by which a spring clamp is fixed also clamps the curtain rod. It is advantageous that the spring clamps as unstressed have such a wide opening that a curtain rod can be laid in them without being scratched and then clamped by the screw 40 being tightened. On each rod, a hook 41,42 is shown of each one of two panel hangers. The clamps 36,37 leave the upper portions of the curtain rods free as sliding surfaces for the hooks of the panel hangers so that the hooks can freely pass the curtain brackets. Alternatively, it would be possible to use closed clamps or pieces of tubes around the curtain rods if the clamps or tubes are thin enough to permit the hooks to pass them.

Figure 8:
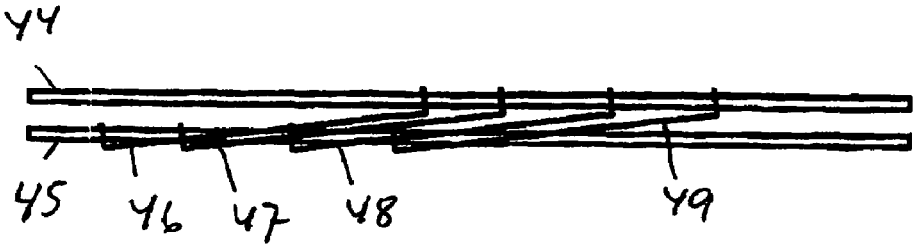
FIG. 8 is a fragmentary view seen from above of a hanger mounted on two curtain rods.

FIG. 8 shows, seen from above, one end of two curtain rods 44,45 and four hangers 46-49, and the hangers have one of their hooks laid on one of the curtain rods and the other hook on the other curtain rod so that the flat hanging curtains can be pulled aside and become overlapping as shown. In this way, many panel curtains can simply be pulled aside so that they do not occupy much more space than a single curtain.

The invention claimed is:

1. A system for hanging curtains flatly, said system comprising two or more elongate hangers (15), and a rod (16), each said elongate hanger having an open suspension hook at each end thereof, each said hook is directly connected to said rod (16) so as to be slideable along the rod, and a single curtain mounted flatly on each said elongate hanger so as not to be foldable and to move with the elongate hanger along the rod without folding.

2. A system according to claim 1, characterised in that said system comprises said rod brackets (30-33) for mounting said rod, at least one of said brackets is arranged to permit the hooks to slide past said at least one bracket.

3. A system according to claim 2, characterised in that at least one of said brackets (30-33) is arranged to leave the upper surface of the rod free as a sliding surface for the hooks.

4. A system according to claim 3, characterised in that said at least one of the brackets comprises clamping means (36, 37) for clamping the rod (16) fixed.

5. A system according to claim 1, characterised in that the hooks (21-24, 17, 26, 41, 42) are arranged to be laid onto the rod.

6. A system according to claim 1, characterised in that the hooks (21-24, 17, 26, 41, 42) have an opening at least as big as the diameter of the curtain rod.

7. A method of hanging panel curtains flatly for slideable movement along a rod that is affixed to a substructure by more than one bracket, characterised in that at least two elongated hangers (15) each having open suspension hooks (21-24) at both ends thereof, and a rod upon which said elongated hangers are to be suspended, are provided, each said hook is directly connected to said rod, in that a single curtain (11-14) is mounted flatly on each of the elongated hangers so as not to be foldable and to be movable along the rod without folding, and in that the elongated hangers are suspended on the rod (16, 38, 39) with the open suspension hooks on the rod.

8. A method according to claim 7, characterised in that the brackets (30-33) of the rod are adapted to permit for the open suspension hooks to pass the brackets.

9. A method according to claim 8, characterised in that two or more of said elongated hangers (15) are hung overlapping each other on the same rod (16) so that they can be mutually moved but not separated.

10. A method according to claim 8, characterised in that the brackets used leave a part of the surface of the rod free as a sliding surface for the open suspension hooks (21-24; 17, 26; 41, 42).

11. A method according to claim 10, characterised in that two or more of said elongated hangers (15) are hung overlapping each other on the same rod (16) so that they can be mutually moved but not separated.

12. A method according to claim 10, characterised in that the open suspension hooks (21-24; 17, 26, 41, 42) used have a design that permit them to be put onto the rod (16).

13. A method according to claim 8, characterised in that the open suspension hooks (21-24; 17, 26, 41, 42) used have a design that permit them to be put onto the rod (16).

14. A method according to claim 7, characterised in that two or more of said elongated hangers (15) are hung overlapping each other on the same said rod (16) so that said elongated hangers are independently and mutually movable but not separated.

15. A method according to claim 7, characterised in that the open suspension hooks (21-24; 17, 26, 41, 42) used have a design that permit them to be put onto the rod (16).

16. A method of hanging curtains flatly for slideable movement along at least one rod that is affixed to a substructure by more than one bracket, characterised in that at least two elongated hangers (15) each having open suspension hooks (21-24) at both ends thereof, and at least two rods, are provided, at least one said hook of at least one of the elongated hangers being placed on one said rod, and another said hook of said other elongated hanger being placed on said other rod, and a single curtain (11-14) is mounted flatly on each of the elongated hangers so as not to be foldable and to be movable along the rods without folding, said elongated hangers being suspended on said rods with the open suspension hooks on the rods.

17. A method of hanging curtains flatly for slideable movement along at least one rod that is affixed to a substructure by more than one bracket, characterised in that at least two elongated hangers (15) each having open suspension hooks (21-24) at both ends thereof and at least two rods are provided, at least one said hook of at least one of the elongated hangers being placed on one said rod, and another said hook of said other elongated hanger being placed on said other rod, and a single curtain (11-14) is mounted flatly on each of the elongated hangers so as not to be foldable and to be movable along the rods without folding, said elongated hangers being suspended on said rods with the open suspension hooks on the rods, the brackets of the rods permitting the open suspension hooks to pass the brackets.

* * * * *

UNITED STATES PATENT AND TRADEMARK OFFICE

CERTIFICATE OF CORRECTION

PATENT NO. : 7,237,303 B2
APPLICATION NO. : 10/500612
DATED : July 3, 2007
INVENTOR(S) : Stefan Schorling It is certified that error appears in the above-identified patent and that said Letters Patent is hereby corrected as shown below:

Claim 2, Line 2 (Col. 3, Line 11),
Delete: "said rod".

Signed and Sealed this

Fourteenth Day of August, 2007

JON W. DUDAS
*Director of the United States Patent and Trademark Office*